US007867050B2

(12) United States Patent
Crispin

(10) Patent No.: US 7,867,050 B2
(45) Date of Patent: Jan. 11, 2011

(54) PADDLE ASSIST TO POP-UP DEVICE

(76) Inventor: Dennis Crispin, 1274 Calle Violeta, Thousand Oaks, CA (US) 91360

( * ) Notice: Subject to any disclaimer, the term of this patent is extended or adjusted under 35 U.S.C. 154(b) by 181 days.

(21) Appl. No.: 12/209,840

(22) Filed: Sep. 12, 2008

(65) Prior Publication Data

US 2009/0270002 A1 Oct. 29, 2009

Related U.S. Application Data

(63) Continuation-in-part of application No. 12/110,990, filed on Apr. 28, 2008.

(51) Int. Cl.
*A63C 5/03* (2006.01)
*B63B 35/81* (2006.01)

(52) U.S. Cl. ..... 441/74

(58) Field of Classification Search ..... 441/74, 441/77, 79

See application file for complete search history.

(56) References Cited

U.S. PATENT DOCUMENTS

| | | | | |
|---|---|---|---|---|
| 4,698,033 | A | 10/1987 | Hall | |
| 4,923,427 | A | 5/1990 | Roland | |
| 5,106,331 | A | 4/1992 | Lizarazu | |
| 5,308,271 | A | 5/1994 | Foulke | |
| 5,435,765 | A | 7/1995 | Fletcher | |
| 5,707,266 | A | 1/1998 | Arena | |
| 5,766,051 | A | 6/1998 | Messer | |
| 5,910,035 | A | 6/1999 | Rebotier et al. | |
| 6,007,394 | A | 12/1999 | Kagan | |
| 6,440,526 | B1 | 8/2002 | Gamble et al. | |
| 7,252,625 | B1 | 8/2007 | Perka | |
| 7,316,597 | B2 * | 1/2008 | Skedeleski | 441/65 |
| 2003/0224676 | A1 | 12/2003 | Takahashi | |

OTHER PUBLICATIONS

"Body Glove Wetsuits—Chest Wedge Paddle Aid 1mm (short arm surf shirt)," Katin Online Surf Shop, http://www.katinsurf.com/Chest-Wedge-Paddle-Aid-1mm-short-arm-surf-shirt-p-17012.html, printed on May 16, 2008, 3 pages.

(Continued)

*Primary Examiner*—Daniel V Venne
(74) *Attorney, Agent, or Firm*—Lewis, Rice & Fingersh, L.C.

(57) ABSTRACT

A device for attachment to the deck of a surfboard or paddleboard for making paddling a surfboard or paddleboard more comfortable and easier to paddle. On a surfboard the device can also assist in attaining proper speed and so that a surfer can more easily "pop-up." The pop-up assist generally comprises a main body having a generally wedge shape attached to the deck of the surfboard generally where the lower chest or abdomen of the surfer, makes contact with the board. The pop-up assist generally creates a wedge between the body of the surfer or paddler and the deck of the surfboard, lifting the user's upper chest, neck and, head up from the deck of the board. The pop-up assist can also be collapsible, so that the obstruction of the wedge on the board is removed once the user "pops-up."

19 Claims, 11 Drawing Sheets

OTHER PUBLICATIONS

"Surfing Lesson Two—Learning to Paddle Your Surfboard," Surfing Waves, http://www.surfing-waves.com/surfing_lesson_two.htm, printed on Jun. 3, 2008, 3 pages.
"Surfing How-to: Paddle Out," Active.com, http://www.active.com/actionsports/Articles/Surfing_How-to_Paddle_Out.htm?PageMod..., printed on Apr. 16, 2008, 2 pages.
Hamatake, K., "Beginners Guide to Surfing—Getting Ready For Your First Day 70," http://hubpages.com/hub/Guide-to-Surfing, printed on Jul. 21, 2008, 5 pages.
DiMartino, J., "Paddling Out for the First Time," http://surfing.about.com/cs/surfinstruction/a/080103paddling.html?p=1, 2007, printed on Jul. 21, 2008, 1 page.
"Surfing tips from the Plyrack: How to Surf," http://members.shaw.ca/kevin_bartlett_175/how_to_surf.html, printed on Mar. 31, 2008, 2 pages.
"Ollypop Surf Towel—practice popping up anywhere," http://nollie.tv/2006/12/ollypop_surf_to.html, printed on Mar. 31, 2008, 2 pages.
"Surf—Popping up to Your Knees," MonkeySee, http://www.monkeysee.com/play/1145-surf-popping-up-to-your-knees, printed on Mar. 31, 2008, 3 pages.
Moise, S., "Get a Life: Surfing: Sand in my bathing suit and a grin on my face," Charleston Regional Business Journal, http://www.charlestonbusiness.com/pub/cgi-bin/udt/im.display.printable?client_id=charles..., May 31, 2004, 2 pages.
"Dry-Land Surf Prep Class," http://www.endlesslope.com/SurfDryClass.htm, printed on Mar. 31, 2008, 2 pages.
"Neoprene," http://en.wikipedia.org/wiki/Neoprene, printed on Jul. 21, 2008, 3 pages.
"12'0" Paddle Board," SurfTech, http://www.surftech.com/boards.phtml?type=Paddleboards&typeID=, printed on Apr. 25, 2008, 2 pages.
"Surfboard," http://en.wikipedia.org/wiki/Surfboard, printed on Apr. 2, 2008, 4 pages.
International Search Report, International Patent Application No. PCT/US09/36494, mailed on Oct. 26, 2009, 10 sheets.

* cited by examiner

PADDLE ASSIST TO POP-UP DEVICE

CROSS REFERENCE TO RELATED APPLICATION

This application is a Continuation-In-Part of the U.S. patent application Ser. No. 12/110,990, filed Apr. 28, 2008 and currently pending, the entire disclosure of which is herein incorporated by reference.

BACKGROUND

1. Field of the Invention

This invention relates to the field of surfboards and paddleboards, more particularly to attachments or modifications to the decks of surfboards and paddleboards for assisting the user in paddling and standing up on surfboards and paddling paddleboards.

2. Description of the Related Art

Surfing is a popular surface water sport in which the participant is carried along the face of a breaking wave using a surfboard. Surfing requires balance, coordination and dexterity. Some of the most difficult aspects of learning to surf are paddling to the speed of the wave, maintaining a nice smooth motion in changing from a paddling position to a standing position, keeping one's center of gravity low once standing on the board, and maintaining a good flexed balance on the centerline or "stringer" of the board.

Surfing begins with the surfer eyeing a wave on the horizon and then attempting to match its speed toward the beach by paddling. Once the wave has started to carry the surfer forward, the surfer quickly jumps, or in surfer lingo "pops-up," to his or her feet and proceeds to ride down the face of the wave, generally staying just ahead of the whitewater of the wave.

The two most common challenges for surfers are paddling out to the waves and, once there, the task of paddling the board fast enough to pop-up on the board. The object of paddling is to get the surfer out to the lineup of the waves with their board. While the movements of paddling are simple, it becomes much harder in the ocean as the surfer has to balance their body on the board in moving water while being deterred by the currents, wind and waves. Developing a proficiency at paddling is important for several reasons: 1) if a surfer cannot paddle well, he or she will not be able to get out beyond the breaking waves to the line up (i.e., the place in the water where the waves break)—he or she will never get a decent ride on a wave; 2) if a surfer is slower at paddling they will lose all the waves to the other surfers in the ocean that day; and 3) the more effort it takes a surfer to paddle out to the line-up, the more likely it is that the surfer will be caught by breaking waves, which can make paddling even harder, tiring the surfer.

Paddling begins outside of the water, with the surfer taking a moment to study the waves and decide upon the path to travel. The next steps generally proceed as follows: first, the surfer wades out into the water with their board until the water is waist-to-chest deep, then, the surfer must lay their body on the deck of the surfboard, generally in the prone position. A surfer frequently will have difficulty paddling out because of poor body positioning on the deck of the board. If the surfer is too far back on the board, it will tilt up in the front causing resistance that will make paddling the surfboard harder as well as potentially making it hard to see in front of the board. Further, if the surfer is too far forward on the surfboard, then the nose will sink, causing the surfer difficulty in maneuvering the board.

A surfer is in proper position when their body weight is positioned along the centerline or "stringer" of the board, their feet are raised slightly off the board and their body is positioned to keep the board on the surface of the water creating minimum drag. Once on the board, the surfer must begin to paddle slowly and smoothly, finishing each paddle stroke before starting the next one. The arm movement should be like that of the freestyle swim stroke: the arm should be stretched outright, fingertips pointed and together with each hand entering the water smoothly. The surfer must keep their head and chest lifted, with a slight arch in their back, at all times through the paddling process. This general method for paddling out to the waves is used because it allows a surfer to maintain balance on the board in the water and, with their chest raised and eyes ahead, puts the surfer's or paddler's arms, shoulders and upper body in a good position to propel their body through the water towards their target.

Despite its advantages, this method of paddling can be an uncomfortable and daunting task. Further, the act of raising one's chest/torso above the surface of the board can cause fatigue and strain in the musculoskeletal system of the surfer's lumbar, thoracic and cervical spine regions. Over time, the surfer has the possibility of developing chronic back pain and muscle tension, among other physical problems, from this motion. Due to these problems associated with paddling, alternative methods such as tow-in surfing, where paddling is eliminated by the use of a personal watercraft, and stand-up paddle surfing, where a paddle is used by the surfer to get out to the line-up, have gained in popularity.

Popping-up is the motion where surfers go from the paddling position, lying face down on their board, to standing up, all in one jump. Broken down into steps, the pop-up motion generally begins with the surfer lying on their stomach in the prone position on the board, with their hands palms down on either side of their chest and with their legs together. Once in this position, the surfer must do a push-up, such that all of their weight is now supported by their hands, just as in a regular push-up, but with an arched back so that the surfer's upper body is elevated and their pelvis more or less remains on the board. Keeping their hands firmly on the board, the surfer then must bring their knees up to their chest, such that their feet swing in under their body like a pendulum. The surfer will want to end up with their feet pointing somewhat across the board, with the heels on one side of the centerline or stringer of the board and the balls of the feet and toes on the other side of the centerline or stringer (or with the reverse foot position depending on the surfer's foot preference). After this, the surfer will be in a deep crouched position with their body facing sideways and their weight centered, head up with their eyes looking forward, feet slightly wider than their shoulders, and with their arms bent out from their sides, slightly forward. The popping-up motion developed as a way for the surfer to stand up on their board while maintaining control and balance of the board with their feet, their weight, and the center line of the board.

In summary, surfing requires the strength to paddle out to the waves and the strength to lift, or "pop-up" off of one's board. Consequently, beginner surfers with little upper body strength or little experience with the motions required to paddle out to a wave and properly pop-up can find these two tasks difficult and daunting. Also, paddleboarders require stamina to endure staying in the prone paddling position.

Previously, practicing paddling and popping-up on dry land prior to hitting the ocean were the methods used to combat the problems associated with paddling and popping-up on a surfboard. While practice is valuable, even for experienced surfers, the equipment does not always make the task of paddling and popping-up easy. Further, paddling, even for those skilled in it, can be hard on the body of the surfer due to their ribs being pressed into the board and the strain and tension in the muscles of the surfer's back that results from maintaining the proper raised paddling position.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems known to those of skill in the art, described herein, amongst other things, is a pop-up assist or other means comprising a generally wedge shape pad designed to be attached to, or formed as a part of, a surfboard or paddleboard that collapses once a user "pops-up" on the surfboard.

In an embodiment of the collapsible pop-up assist for attachment to a deck of a surfboard, said collapsible pop-up assist comprises: a face plate and a brace; wherein the face plate and the brace form a general wedge shape with the deck of the surfboard when in an upright position with a distal end toward a tail of the surfboard and a larger proximal end toward the nose of the surfboard; wherein the brace supports the face plate in the upright position; wherein the collapsible pop-up assist device, when in the upright position, serves as a wedge between the body of the user lying flat on his or her stomach in the prone position on the surfboard and the board separating their upper torso from the deck; wherein after the weight of the user's upper torso is removed from the face plate, the collapsible pop-up assist collapses to a collapsed position and wherein when in the collapsed position the face plate and the brace are generally parallel to the deck of the surfboard.

In another embodiment of the collapsible pop-up, the collapsible pop-up assist is further comprised of: a locking mechanism; wherein the locking mechanism secures the collapsible pop-up assist in the upright position while the weight of the user's upper torso is resting on the face plate.

In one embodiment, this locking mechanism is a pin and hole system.

In yet another embodiment of the collapsible pop-up assist device, the collapsible pop-up assist device is designed to be attached to a deck of a surfboard by a permanent attachment system.

In another embodiment of the collapsible pop-up assist device, the collapsible pop-up assist device is built-into the surfboard.

In yet another embodiment of the wherein the face plate is covered by a layer of cushioning substance.

In another embodiment, the collapsible pop-up assist device is formed of a hard yet durable material.

In another embodiment of the collapsible pop-up assist, the face plate is a generally rectangular 10" wide by 6" long plate and the brace is generally a rectangular 1" tall by 7" wide plate.

In yet another embodiment of the collapsible pop-up assist, a distal end of the brace is attached toward a proximal end of the face plate.

In another embodiment of the collapsible pop-up assist, the collapsible pop-up assist further comprises: a housing; wherein the housing encloses the parameters of the face plate and the brace and is the point of attachment to the deck of the surfboard.

In an embodiment, the housing will be generally a rectangular 10" by 6" long by ½" thick frame.

In still a further embodiment, the face plate will be attached to the housing via a hinged mechanism.

In another embodiment, the face plate will be biased to a collapsed position.

In yet another embodiment, the collapsible pop-up assist further comprises: a push tab; wherein the push tab is located toward the proximal end of the brace; and wherein the push tab is biased to force the brace from the upright position to the collapsed position after the weight of the user's upper torso is removed from the face plate.

In another embodiment, the push tab is generally 1" wide by 6" long and is spring-loaded and has an angled end surface to allow easier sliding and collapsing of the collapsible pop-up device.

In another embodiment of the collapsible pop-up assist, the pop-up assist further comprises: a pull-tab; wherein the pull tab has a distal end and a proximal end, with distal end attached to the brace and the proximal end generally extending out from the nose of the surfboard; and wherein the pull tab is used to transition the collapsible pop-up assist from a collapsed position to an upright position.

In another embodiment of a collapsible pop-up assist device, the pull tab has a knob located at its proximal end making it easier for a user to extend or "pull" the pull tab.

Also disclosed herein is a surfboard comprising: a deck originating at a tail and extending to a nose; a bottom opposing the deck and including at least one fin; a generally wedge shaped protrusion extending from the deck, the protrusion including a taller proximal and a shorter distal end and a length therebetween; wherein the taller proximal end of the protrusion is positioned toward the nose and the shorter distal end is positioned toward the tail; and wherein the wedge shaped protrusion is positioned on the surfboard so as to contact a user's body between the neck and the abdomen when the user lies prone on the deck wherein the wedge shaped protrusion collapses from an upright position to a collapsed position after a user "pops-up" and removes a weight of the user's upper torso from the wedge and wherein when the user is standing on the board, the wedge shaped protrusion is in a collapsed position and there is generally no obstruction on the deck of the surfboard to inhibit the user from enjoying a free range of movement on the deck of the board.

BRIEF DESCRIPTION OF THE FIGURES

FIG. 17(*a*) provides an embodiment of the collapsible pop-up assist in the upright position. FIG. 17(*b*) provides an embodiment of the collapsible pop-up assist in the step in which the locked mechanism has been released, and the brace is parallel to the underside of the face plate. FIG. 17(*c*) provides an embodiment of the collapsible pop-up assist in the collapsed position.

BRIEF DESCRIPTION OF THE PREFFERED EMBODIMENT(S)

Figure 1:
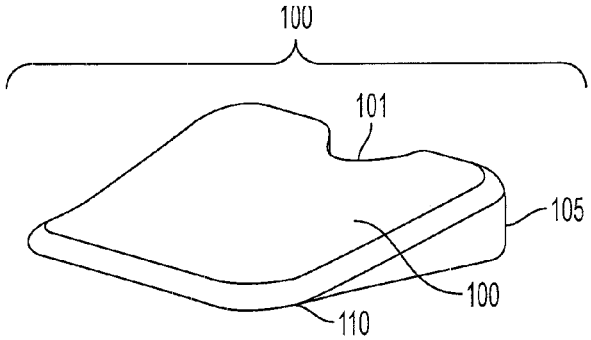
FIG. 1 provides a rear perspective view of an embodiment of a pad.

The following detailed description illustrates by way of example and not by way of limitation. The parent of this application, U.S. application Ser. No. 12/110,990 provides for a number of more rigidly positioned pop-up and paddle assist devices and the entire disclosure of that document is herein incorporated by reference.

The term surfboard, as used herein generally refers to longboards, funboards, shortboards, and other surfboards where a user will generally stand, at least for a portion of the time, on the board and where it is generally necessary to switch from the prone paddling position to the standing position. The embodiments, herein will generally be focused on the device's use on surfboards since on these devices popping-up is generally part of the traditional manner of use. It should be recognized that the device can also be used on paddleboards or any other similar buoyant equipment which is intended to be used only in the prone position without popping up. Use on these boards, however, is generally a simplified version of the use on a surfboard.

Described herein, among other things, is a device (100) that attaches to a surfboard (304) that serves as a wedge between the body of the user (351) lying flat on their stomach in the paddling position prone to the surfboard (304) and the board (304) itself so that the user's (351) chest/torso is raised (580). This effectively takes the strain off the lower rib cage of the user's (351) chest/torso by spreading the pressure points normally focused on the deck of the surfboard (154) onto the wedge pad device (100), thus making it more comfortable for the user (351) to arch their back (127). This enables easier paddling and popping-up for the user (351). The pad (100) also functions to support the chest of the user (351) in the paddling position, thus decreasing muscle strain and tension in the user's (351) back in the paddling position, offering comfort.

Depending on the particular embodiment, the device (100) may be constructed in several methods. First, the device (100) maybe separate to the surfboard (304) and retrofitted onto the board (304) through an attachment system. Alternatively, the device (100) may be constructed as part of the board (304). By no means are either of these methods required.

Figure 2:
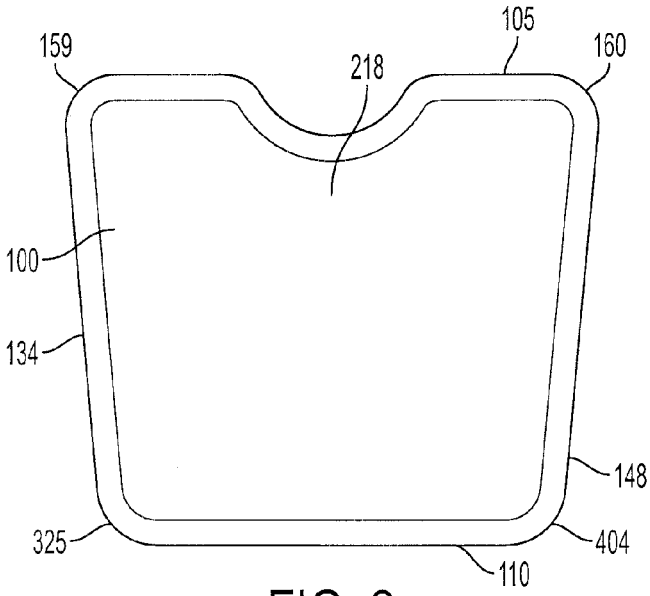
FIG. 2 provides a top view of the embodiment of FIG. 1.
Figure 3:
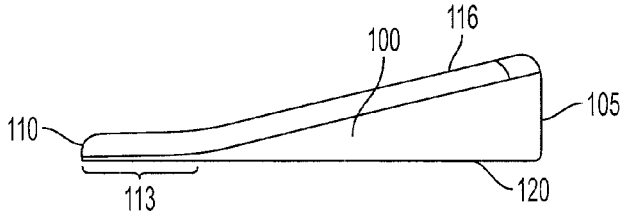
FIG. 3 provides a side view of the embodiment of FIG. 1.
Figure 4:
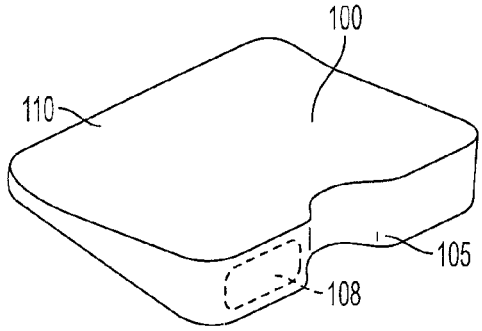
FIG. 4 provides a front perspective view of the embodiment of FIG. 1.

The assist (100) is a generally wedge shaped structure having a smaller distal end (110) and a larger proximal end (105). FIGS. 1 through 3 provide for various different views of a first embodiment of a pop-up assist (100) which is a fixed wedge shape. In the depicted embodiment, the pop-up assist (100) is generally designed to be attached to a previously constructed surfboard (304). In the depicted embodiment, there is a concave depression (101) on the proximal end (105) of the pad (100) that runs from the upper surface (116) to the lower surface (120).

Figure 7:
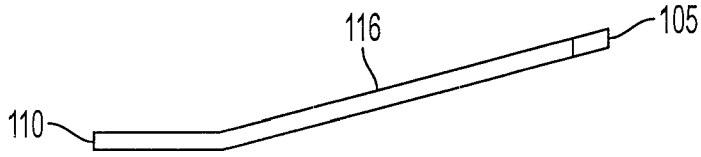
FIG. 7 provides a side view of the upper surface of a pad constructed of three components.
Figure 8:
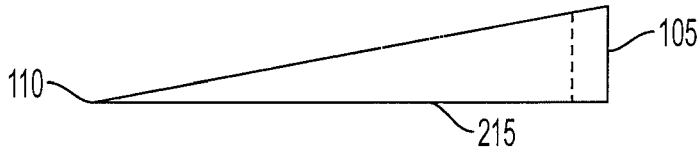
FIG. 8 provides a side view of the main body of the pad of FIG. 7.
Figure 9:
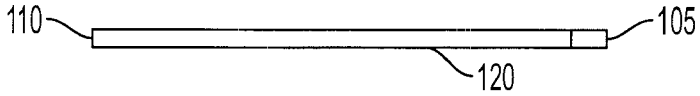
FIG. 9 provides a side view of the lower surface of the pad of FIG. 7.

The pop-up assist (100) of this embodiment will generally be molded as a single unitary piece of material, however this is by no means required and the device (100) may be formed of multiple components which are permanently or temporarily connected or placed together. The component parts of an embodiment of a device (100) are shown in FIGS. 7-9, where the device (100), comprises a lower surface (120), a middle wedge shaped body (215) and an upper surface (116). The upper surface (116) of the pop-up assist (100) will generally be in an anatomically correct shape so as to contour to the chest/torso area of the user (351), but this is by no means required.

The main body of the pop-up assist (100), as exemplified in the depicted embodiment of FIG. 3, is a generally wedge shaped design. The proximal end (105) of the main body is generally greater in height than the distal end (110) of the main body which results in a taper in the upper surface (116) along the length of the main body from the proximal end (105) to near the distal end (110). This creates a generally smooth gradient from the proximal end (105) of the main body to the distal end (110) of the main body.

In the depicted embodiment, at a point approximately ¾ths of the way to the distal end (110) of the device, the taper of the upper surface (116) ends and the upper surface (116) of the pop-up device (100) continues generally parallel to the lower surface (120) for the remaining distance of the upper surface (116), creating a flat area (113) of the pad (100). This embodiment is most clearly illustrated in FIGS. 1 & 3. This flat parallel portion of the device (100) functions as a cushion for the lower rib cage of the user (351) without actually directing the projection of the user's torso; thus further increasing the support and comfort of the user (351) in the prone position. While preferred, this parallel portion of the device is by no means required and the entire wedge (100) may be tapered. The general slope of the taper of the wedge pad (100) is generally designed to be relatively linear but that is by no means required.

In the depicted embodiment of FIGS. 1-3, the proximal end (105) of the wedge pad (100) contains a generally concave shaped depression (101). This concave depression (101) runs from the upper surface (116) of the wedge pad (100) to the lower surface (120) of the wedge pad (100). The concave depression (101) is generally located in the central area of the proximal end (105) of the wedge pad (100). The depression (101) is generally crescent shaped where a crescent shape generally is the shape of the moon in its first or last quarter, resembling a segment of a ring tapering to points at the ends as seen in FIG. 2. In alternative embodiments, slightly different shapes may be used. An example is shown in shown in FIG. 6 which has a polygonal-type shape, such as, but not limited to, the shape of the lower half of a hexagon. By no means are either of these shapes required and other depressions may be included, or the depression may be entirely eliminated.

In an embodiment, the width of the device (100) will be about 9-10", the length of the device (100), will be about 5"-8", the thickness of the device (100) will range from about 1"-2" at the thick end to about ¼"-½" at the thin end. These measurements are by no means limiting or exclusive but provide for general ranges which can be comfortable and assistive to users of more average body size and shape. In other embodiments, small, medium and larger sizes of the device will be constructed to conform to particular user sizes, or for particular uses.

Functionally, the general wedge shape of the main body, generally reduces the strain on the user's (351) chest/torso area by spreading the pressure-points normally focused on the deck of the surfboard (154) on around one or two square inches of each side (both left and right) of the chest/torso of the user (351). This decreased resistance on the user's (351) chest/torso makes it easier for the user (351) to pop-up. Further, in addition to reducing strain, increasing comfort and providing additional support, the concave depression and general wedge shape of the device (100) also effectively raises the user's (351) chest/torso (580) such that it is easier to paddle.

Before describing how the device (100) is attached to or constructed as part of a surfboard (304) it is important to briefly overview the structure and types of surfboards (304). Surfboards (304) are the buoyant equipment used in the sport of surfing. Surfboards (304) are generally comprised of the following parts: 1) a nose (43) (the front tip of the board); 2) the tail (182) (the back end of the board); 3) the deck (154) (the surface of the board that the surfer stands on; 4) the bottom (162) (the surface of the board that rests in the water); 5) the rail (24) (the edges of the board); and 5) the fins (313) (also known as "skegs," the fins create stick and drive on the wave face, keeping the board (304) from sliding sideways on a wave uncontrollably); among other various parts. Paddleboards and other boards often have similar components, but generally lack fins as they are not steered on wave faces. Most modern surfboards (304) can be divided into three main categories: longboards, funboards and shortboards. Longboards are longer (usually eight or more feet), thicker and wider. Funboards are a mix between longboards and shortboards, usually between six and eight feet in length. Shortboards are shorter (usually five to seven feet) and thinner. Shortboards are not as wide as longboards and are typically more maneuverable. While most people think of shortboards when they think of surfboards, the other forms of surfboard are actually more common.

A surfboard (304) must be light enough for the surfer (351) to handle, but strong enough to support the weight of the surfer (351) standing on it as well as battering from the waves and water. To achieve both strength and lightness, surfboards (304) are usually constructed using a polyurethane or polystyrene foam. The foam is molded into the rough shape of a surfboard (304) called a blank. Shapers then cut, plane and sand the blank into a board (304). Then the board (304) is then covered in one or more layers of fiberglass cloth and resin. It is generally in this final stage that the fins (313), or boxes for removable fins are attached to the surfboard (304). Boards (304) have also been made using epoxy resin and polystyrene foam, instead of polyester resin and polyurethane foam; balsa and a polystyrene core and solid balsa. The latest materials used have included carbon fiber. While surfboards (304) are generally shaped by hand, the use of machines in shaping has become more and more popular with advances in technology.

Figure 12:
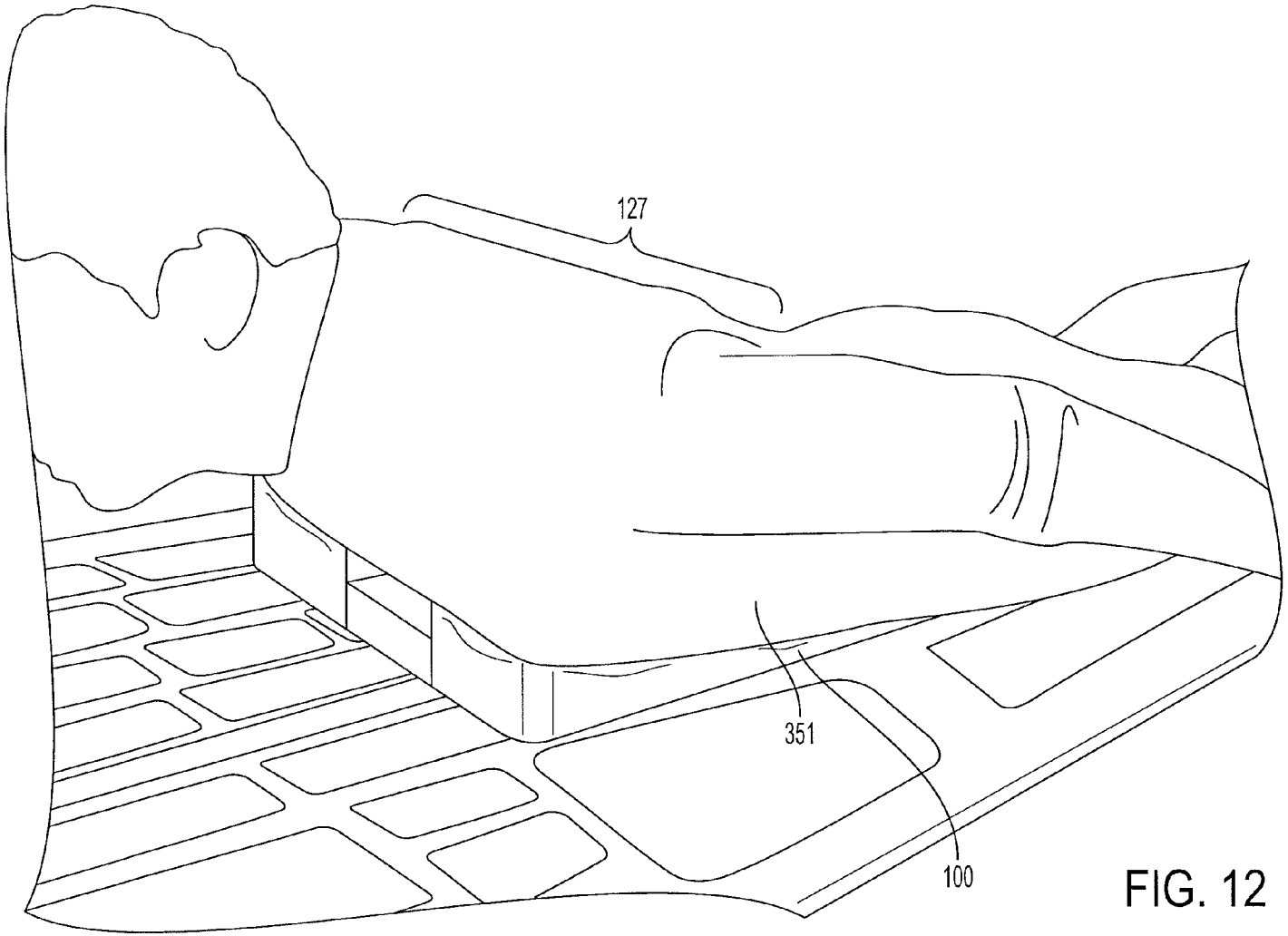
FIG. 12 illustrates a perspective view of a surfer in a paddling motion on a surfboard with a pad affixed thereto. This figure illustrates the decreased surface area of the deck to which the surfer's chest is exposed and how the tri-wedge pad lifts the surfer's chest area.
Figure 13:
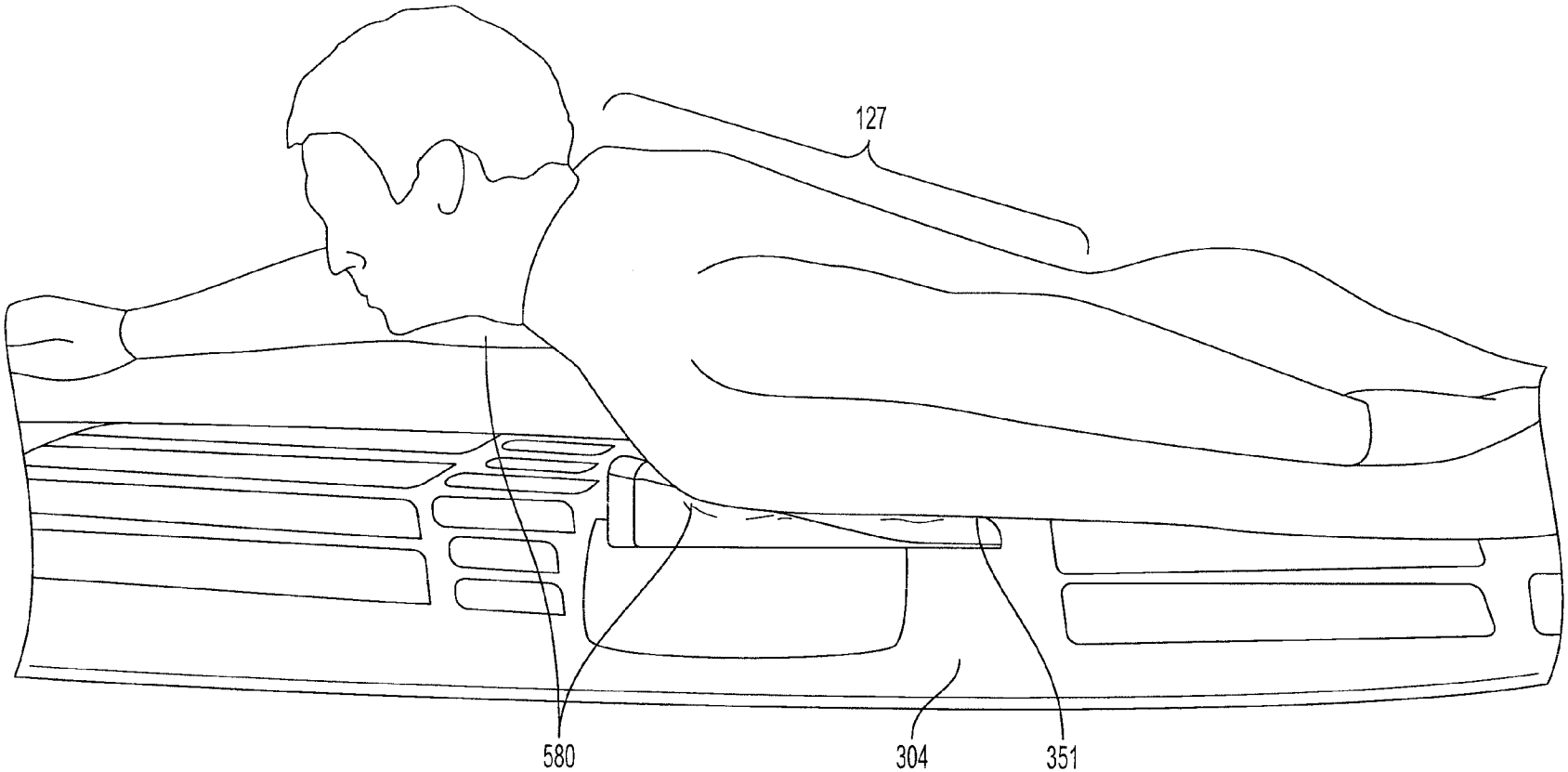
FIG. 13 illustrates a paddling surfer on a surfboard with a pad affixed thereto.

As illustrated in FIG. 12 and FIG. 13, the wedge (100) is generally positioned on the board (304) with the proximal end positioned toward the nose (43) and the distal end positioned toward the tail (182) so that the wedge (100) extends a greater distance from the deck at the forward position than the rearward. The wedge (100) is also generally positioned laterally on the deck (154) where those generally skilled in the art recognize that a particular user's (351) chest should be placed on the deck of the surfboard (154) to achieve the proper paddling position to maintain balance and buoyancy on the board (304) and to have correct positioning when popping-up. In an embodiment, the user's (351) breast will generally be beyond the proximal end of the device (100), with the user's (351) chest contacting the device (100) just below that.

Depending on the size of the board (304), e.g., longboard or shortboard, and the body type of the user (351), this position can generally range from the middle of the board (304) to closer to the nose (43) of the board (304). Further, positioning may also depend on specific ocean conditions being surfed. Generally, the device (100) will be positioned near the center of the surfboard (304), often with the midpoint of the device (100) just slightly ahead of the midpoint of the surfboard (304). In an embodiment of the device on a long board, the distal end is about 4 foot 7 inches from the tail, while the proximal end is about 4 foot 2 inches from the nose rendering the center of the device (100) a few inches forward of center on the surfboard (304).

Fixed to the proper position on the board (304), attachment of the device (100) to the board (304) generally ensures that the user (351) will be able to achieve the proper position to paddle and pop-up on the board (304) as the device (100) acts as a marker to the user (351), designating the place where the user's (351) chest/torso should meet the board (304). In this way, the device (100) can provide for additional ease of use of the board (304) by providing that the board has "custom fit" to the user when they are paddling.

Figure 11:
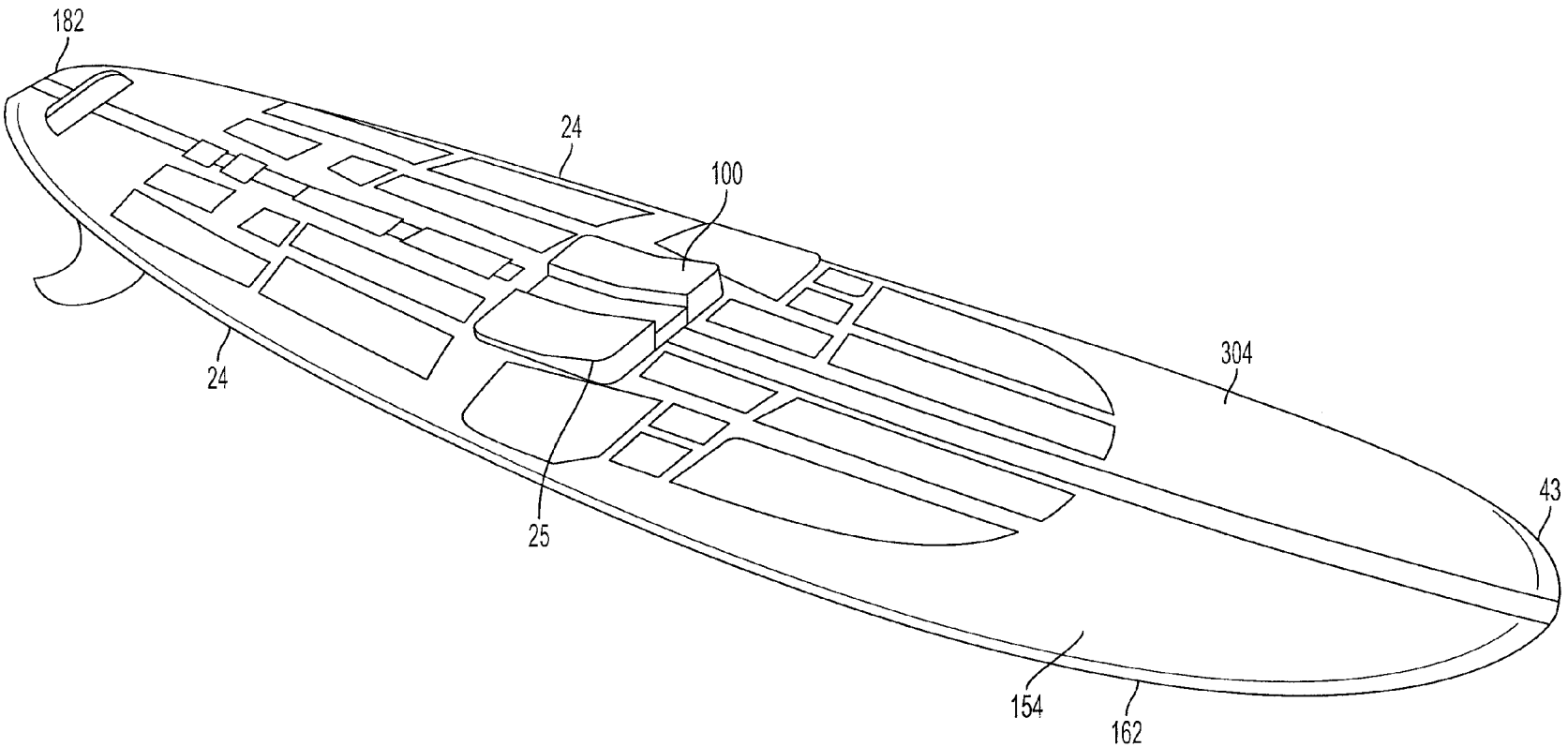
FIG. 11 illustrates a surfboard with a fourth embodiment of a pad affixed thereto.

The pop-up assist (100) is generally attached to the deck of the surfboard (154) by the lower surface (120). This lower surface (120), as seen in FIG. 3 is generally sized and shaped for such attachment which often means it is flat. Generally, the device (100) will be positioned so the lower portion of the user's (351) ribs are in contact with the device (100) with their upper ribs and neck suspended beyond the proximal end (105). This is generally the front-most contact point of the surfer's (351) body and the board (304) in the paddling position. This positioning is illustrated in FIG. 11 and FIG. 13.

In an embodiment where it is removable, the pop-up assist (100) is attached to the deck of the surfboard (154) generally in a two stage process. It is acknowledged that the exact positioning of the pop-up assist (100) depends on the specifics of the attachment at that particular time. Accordingly, the attachment of the pop-up assist (100) can be permanent or moveable, providing different "fitting" options for an individual user (351) or multiple users (351) of the board (304).

In a removable embodiment, the lower surface (120) of the pop-up assist (100) is attached to the deck of the surfboard (154) with hook and loop fastener (e.g., Velcro™). The first stage fastens a piece of the hook and loop fastener material to the deck of the surfboard (154) via an adhesive (generally an adhesive used to fasten pads or traction pads to surfboards (304) may be used). Next, a mating piece of hook and loop fastener material is adhered to the lower surface (120) of the pad (100). The pop-up assist (100) is attached to the surfboard (304) via these two mating pieces of hook and loop fastener material. This method fastens the pop-up assist (100) to the surfboard (304) in a way that is firm, but adjustable, such that a surfer or paddler (351) can adjust the pop-up assist (100) forward or backward while on the surfboard (304) or prior to surfing by releasing the two halves of the hook and loop fastener, moving and then reattaching the device (100). Further, this type of connection allows for the device (100) to be used on surfboards (304) which may be used by a number of different users (351). For example rental surfboards (304) are boards (304) that are used by a number of different surfers (351) with a number of different body types.

In another embodiment, the lower surface (120) of the pop-up assist (100) is attached to the deck of the surfboard (154) via a permanent adhesive (generally an adhesive used to fasten pads or traction pads to surfboards (304) is contemplated; however, any adhesive may be used) to form a bond with the deck of the board (154) that is not easily modifiable by the user (351). This method of attachment results in the device (100) effectively becoming a part of the deck of a surfboard (154) as illustrated in FIG. 11.

In another embodiment, the lower surface (120) of the pop-up assist (100) is attached to the deck of the surfboard (154) via a pin and hole system, or similar attachment device. In this method, the board (304) is either built with a pin and hole fastener system or a pin and hole fastener system is attached to the board (304) via a permanent adhesive. Next, a compatible piece of the pin and hole fastener system is attached to the lower surface (120) of the pop-up assist (100) via a permanent adhesive. The pin and hole system, or similar attachment device creates a strong bond between the pop-up assist (100) and the deck of the surfboard (154). While a number of different alternatives are discussed above, it would be apparent to one of ordinary skill in the art that alternative designs of cohesion or attachment may also be used to attach the pop-up assist (100) to the deck of the surfboard (154).

The pop-up assist (100) will generally be manufactured of a soft yet resilient substance. This may include, but is not limited to, foams, plastics, rubbers, polyester material or other fabric, neoprene, similar materials or a combination thereof. This creates a material consistency of the pop-up assist (100) that is generally soft but firm and slightly lower in density than surfboard (304) "traction pads." Utilization of these materials creates a pop-up assist (100) that offers the user (351) comfort plus support.

In warm weather and water, it is customary in the surfing community to surf without a wetsuit. Accordingly, the pop-up assist (100) generally includes a springy/soft material that will not chafe or aggravate the user's (351) skin. The use of these materials enables a surfer or paddler (351) who does not surf with a wet suit to avoid a rash or other skin irritation that could be caused by use of hasher materials interacting with their skin. The material also needs to engage with sufficient friction to keep the user (351) from unnecessarily sliding, while not so much friction that the user (351) is inhibited from purposefully moving relative to the device (100) when popping-up.

In another embodiment of the pop-up assist (100), the upper surface (116) of the pop-up assist (100) comprises or is covered with a layer of cushioning substance, such as gels, foams, or similar materials. In an embodiment a formed polyurethane gel such as Technogel™or Levagel™, may be used in a generally a ¼ inch to a ½ inch layer. This layer effectively increases the comfort of the pop-up assist (100) for the surfer or paddler (351).

In another embodiment, the elevation and size of the pop-up assist (100) will be adjustable via an air pump or similar system in the pop-up assist (100). The angle at which a user's (351) upper chest/torso needs to be raised is generally dependent upon the size or weight of the user (351). This embodiment contemplates desired variance in the elevation of the wedge (100) for different users (351) or even for different surfing conditions. Accordingly, in this embodiment the elevation or angle of the device (100) can be adjusted for the body types of particular users (351) via the air pump system. Generally, the system will allow the user (351) to pump air into the device (100) to raise the elevation/angle and to deflate the device (100) to lower the elevation/angle of the device (100). This can allow for increased comfort and support for the user (351). Further, this system would generally allow the user (351) to adjust the arch of their back (127) relative to the deck of the board (154) while on the board (304) and in the prone paddling position and/or before a user (351) even gets on the board (304).

Figure 5:
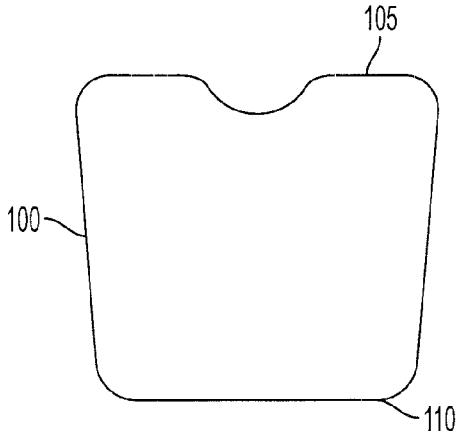
FIG. 5 provides a top view of a second embodiment of a pad.
Figure 6:
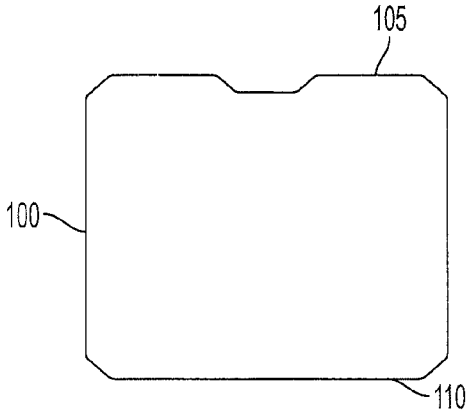
FIG. 6 provides a top view of a third embodiment of a pad.

As seen in the embodiments FIGS. 2, 5, and 6 the general shape of the pop-up assist (100) from a top view is generally rectangular. This general shape is modified slightly in different embodiments. In one embodiment, as seen in FIG. 2, the left lateral side (134) and the right lateral side (148) of the pop-up assist (100) slightly angle towards the center of the wedge (218) at an angle from the proximal end (105) to the distal end (110). The front left corner (159), front right corner (160), rear left corner (325) and rear right corner (404) of the pop-up assist (100) in this embodiment are rounded, as seen in FIG. 2. The edges of the pop-up assist (100) in this embodiment are also generally rounded, as seen in FIG. 1. Rounding of corners can help inhibit the device from being damaged by catching on objects, as well as making the surface more comfortable in interaction with the user.

In another embodiment, as seen in FIG. 5, the left lateral side (134) and the right lateral side (148) of the pop-up assist (100) angle towards the center of the wedge (218) at a slightly steeper angle from the proximal end (105) to the distal end (110). The front left corner (I 59), front right corner (160), rear left corner (325) and rear right corner (404) of the pop-up assist (100) in this embodiment are also rounded, as seen in FIG. 5. The side edges of the pop-up assist (100) in this embodiment are right angles. The inclusion of an angle to the device (100) can allow the device (100) to more accurately reflect the shape of a human user's (351) lower torso. This can assist in making sure the device (100) is under the user (351) and does not impair their arm movement.

In another embodiment the device (100) has no smooth curves on either the sides or the corners. All of the sides of the pop-up assist (100) in this embodiment are at right angles to each other. The front left corner (159), front right corner (160), rear left corner (325) and rear right corner (404) of the pop-up assist (100) in this embodiment are not rounded, but angled at 45 degrees as seen in FIG. 6. This can make the device easier to construct, particularly in machine manufacture.

In another embodiment, the proximal end (105) of the pop-up assist (100) will contain a generally concave shaped pocket (108) between the upper surface (116) and the lower surface (120) that can be used by the surfer or paddler (351) as a key holder (108), or similar storage device. This pocket (108) could also be located on the lower surface (120) or other surface of the pop-up assist. If on the lower surface (120) the pocket (108) will be generally sealed by the tight connection between the pop-up assist (100) and the board (304). If located on an alternative surface, the pocket (108) will be sealable by a zipper, snap or some similar type of enclosure system. Functionally, this pocket (108) acts as a storage compartment providing an additional function for the pop-up assist (100) and benefit for the user (351).

In another embodiment, the pop-up assist (100) will be comprised of two or more wedge shaped pieces (25), that act as a wedge between the user's (351) chest/torso and the board (304). A pop-up assist (100) with two or more wedge shaped pieces (25) is illustrated in FIG. 11. In this embodiment, a series of wedge shaped pieces (25) act in concert to create the device (100) forming a discontinuous platform that raises the chest/torso (580) of the user (351). Generally, the wedge shaped pieces (25) will be placed parallel to each other on the deck of the board (154), but this is by no means required and a slight offset is provided to the pieces in the embodiment of FIG. 11. Each wedge shaped piece (25) may be attached via a permanent or modifiable attachment system. Such a multiple system can provide for further flexibility in arrangement of components, allowing for additional functionality and comfort for a user.

Figure 10:
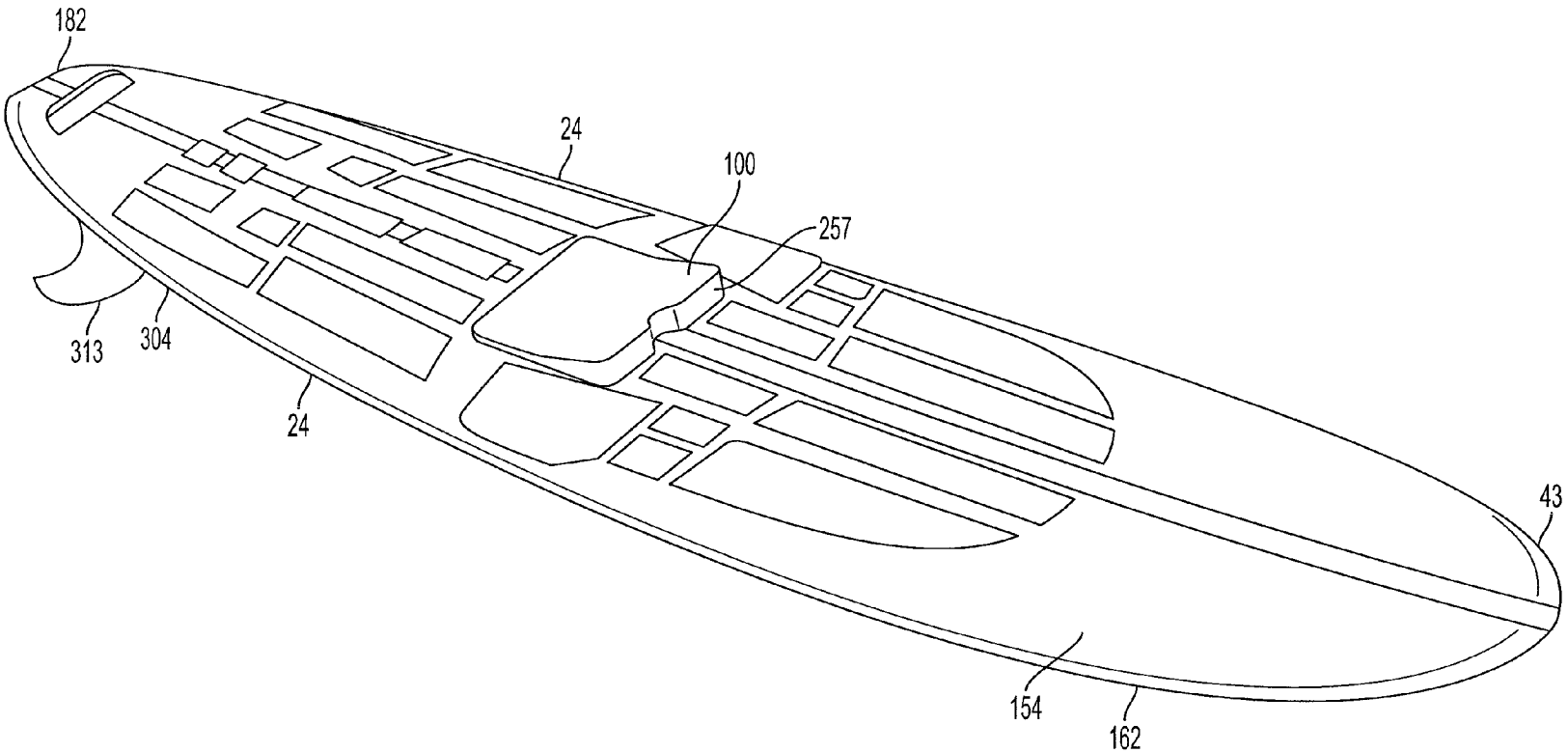
FIG. 10 provides a perspective view of a pad such as that of FIG. 1 attached to the deck of a surfboard.

In another embodiment, the pop-up assist (100) is part of the surfboard (304) as opposed to an attachment. In this embodiment, a surfboard (304) is built/shaped with a generally wedge shaped protrusion (257) on the deck of the surfboard (154) near the expected front-most contact point of the user's (351) body and the board (304) in the trunk area of the human body from the neck to the abdomen. This embodiment is illustrated in FIG. 10. This wedge shaped protrusion (257) can be built during construction or as part of the shaping process, but by no means are either of these methods exclusive. It is contemplated that the wedge shaped protrusion (257) in this embodiment is generally fitted as part of the board (304) to create a unitary piece of equipment, but by no means is this required and the protrusion (257) may be removable, such as for storage or transport.

In another embodiment, the pop-up assist (100) is designed to be collapsible so as to fold closer to, or flush with, the deck of the surfboard (154) when it is not being actively used for paddling. In this way, it is more out of the way of a user's (351) feet when they are standing on the deck of the surfboard (154). Specifically, the user (351) can place their feet on the device without it significantly altering their foot position.

Figure 14:
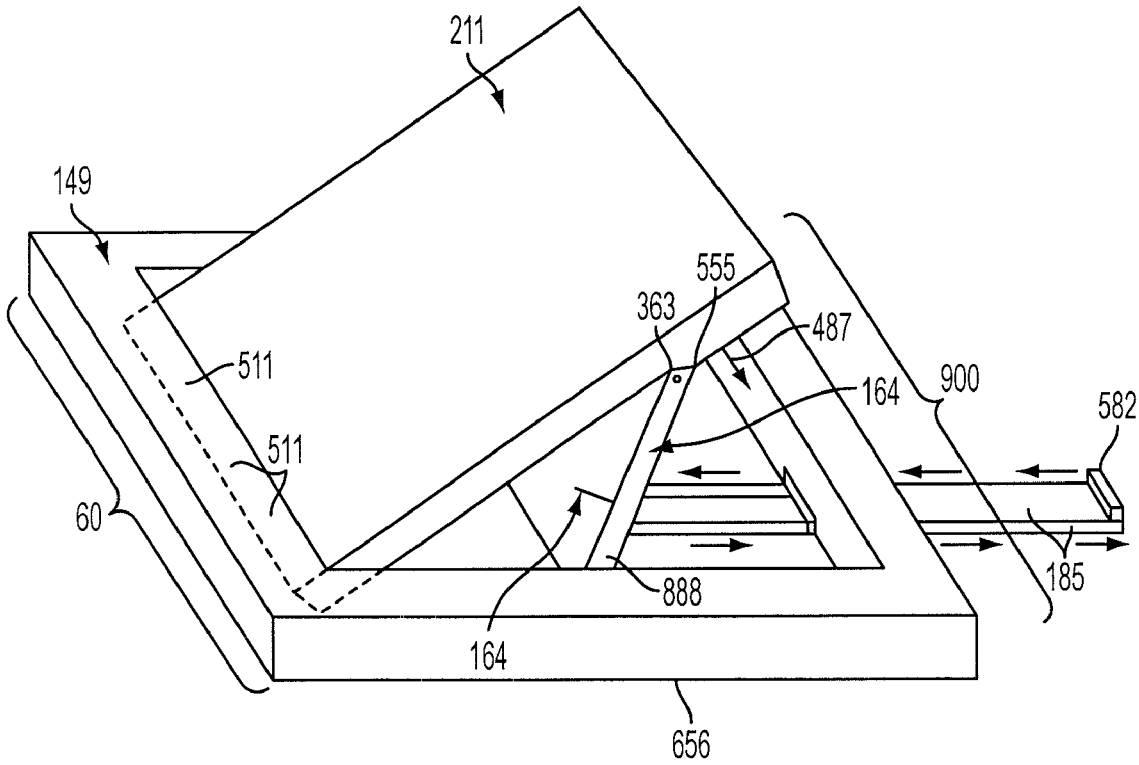
FIG. 14 provides a lateral-perspective view of an embodiment of a collapsible pop-up assist.
Figure 15:
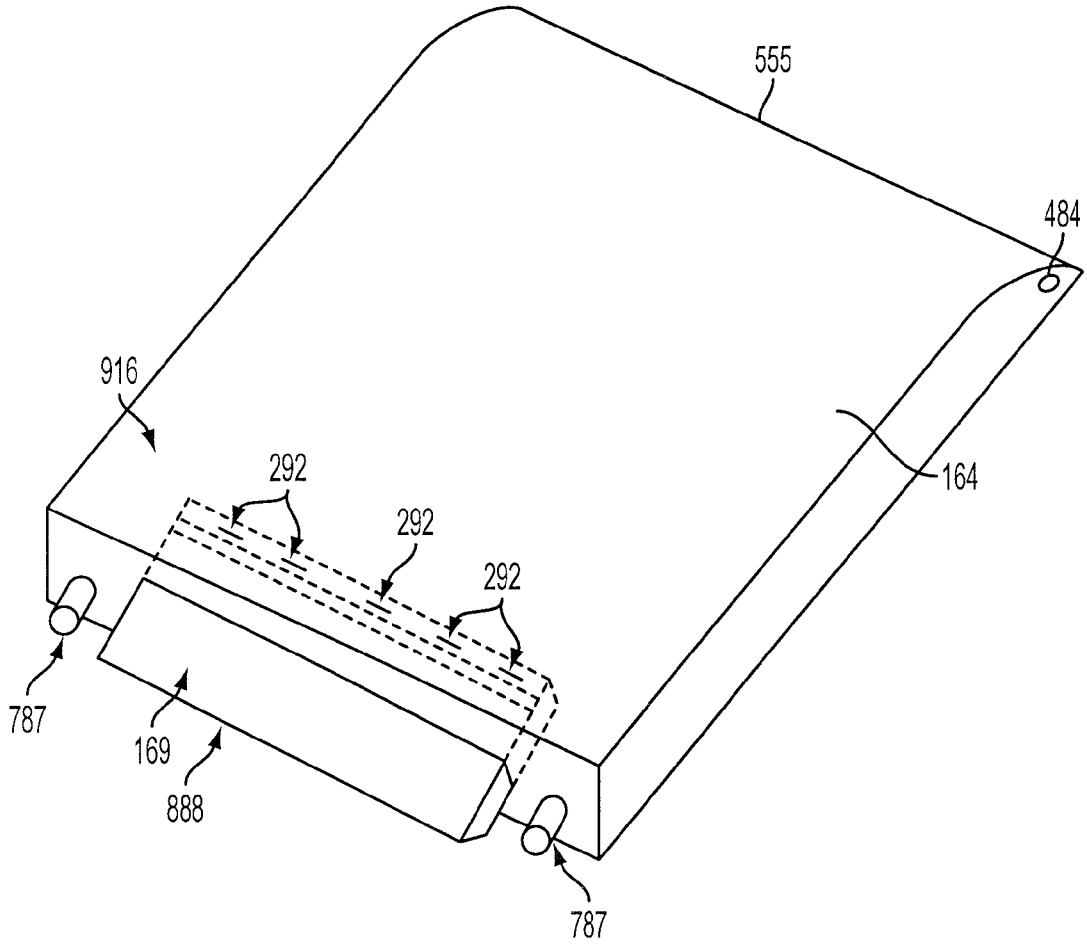
FIG. 15 provides a perspective view of an embodiment of a brace of a collapsible pop-up assist.
Figure 16:
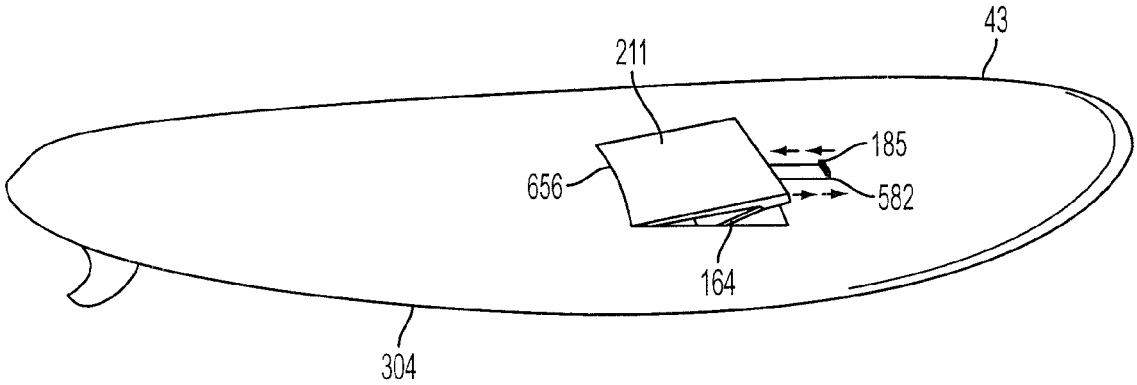
FIG. 16 provides a perspective view of an embodiment of a collapsible pop-up assist built into a surfboard.

An embodiment of a pop-up assist (100) that is collapsible is shown in FIGS. 14-16. In this embodiment of the pop-up assist (100), the pop-up assist (100) automatically lowers onto the deck of the surfboard (154) after a user (351) transitions from a prone paddling position to a standing up position, and no longer needs the support of the pop-up assist (100). This embodiment of the collapsible pop-up assist (656) resolves obstruction problems which may be inherent in a pop-up assist (100) that does not collapse. A pop-up assist (100) may be in the way of a user's (351) foot after they "pop-up." Thus, the collapsible pop-up assist (656) offers the comfort and support without concerns of obstruction problems to the user's (351) proper manipulation or control of the board (304) once standing up.

In an embodiment of the collapsible pop-up assist (656), the collapsible pop-up assist (656) is comprised of generally five main parts in addition to several secondary components. In an embodiment, the five main parts of the collapsible pop-up assist (656) are a face plate (211), a brace (164), housing (149), a pushing tab (169), and a pulling tab (185).

In an embodiment, the collapsible pop-up assist (656) is constructed primarily of a hard, yet resilient, substance such as, but not limited to, hard plastics, Teflon®, metals, woods, hard rubbers or combinations thereof. In an embodiment, the face plate (211) of the collapsible pop-up assist (656) will be covered with a rubber, foam, neoprene or other similar soft, resilient, water-resistant substance to provide comfort for a user (351) and to prevent chafing of the user's (351) chest/upper torso when lying in the prone position on a surfboard (304) with their chest resting on the face plate (211).

In an embodiment, the collapsible pop-up assist (656) will be positioned on the board (304) in the same manner as the pop-up assist (100). Further, the collapsible pop-up assist (656) will generally be attached to the surfboard (304) in the same manner as the pop-up assist (100). In addition to hook and look fastener, permanent adhesive, and a pin and hole system forms of attachment, this application also contemplates that the collapsible pop-up assist (656) can be attached to a board (304) via screws, nails or other forms of permanent attachment known to those skilled in the art. In alternative embodiments, the collapsible pop-up assist (656) can also be built into the surfboard (304) itself. In other words, the structure of the pop-up assist (656) would be recessed or embedded in the surfboard (304). This latter arrangement can provide for particular benefit as it allows the face plate (211) to collapse to a position where it is generally flush with the deck of the surfboard (154).

In the embodiment of a collapsible pop-up assist (656) shown in FIG. 14, the housing (149) of the collapsible pop-up assist (656) may be a generally rectangular frame. In an embodiment, this frame may be internally dimensioned as about 10" wide by about 6" long by about ½" thick however, a housing (149) of any dimensions may be used in other embodiments. While FIG. 14 depicts a rectangular housing (149), it is contemplated that the housing (149) could take any shape known to those skilled in the art that properly functions to encase the other main parts of the collapsible pop-up assist (656). This housing (149), similar to the function of a door frame, acts to encase the hinged collapsible pop-up assist (656).

Figure 17A:
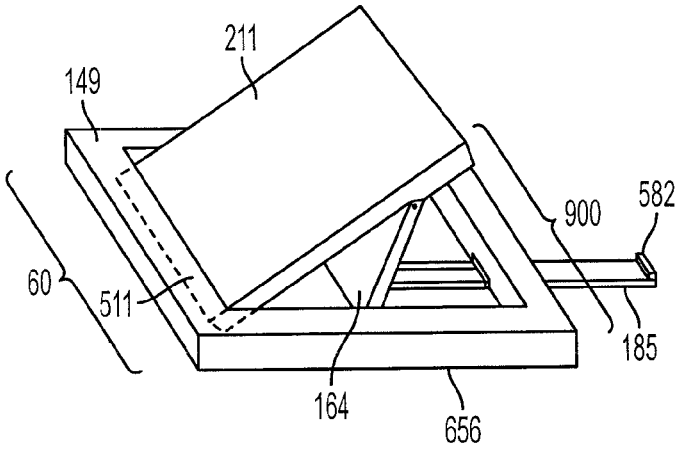
FIG. 17 provides a step-by-step view of an embodiment of the collapsible pop-up assist collapsing from an upright position to a collapsed position.
Figure 17B:
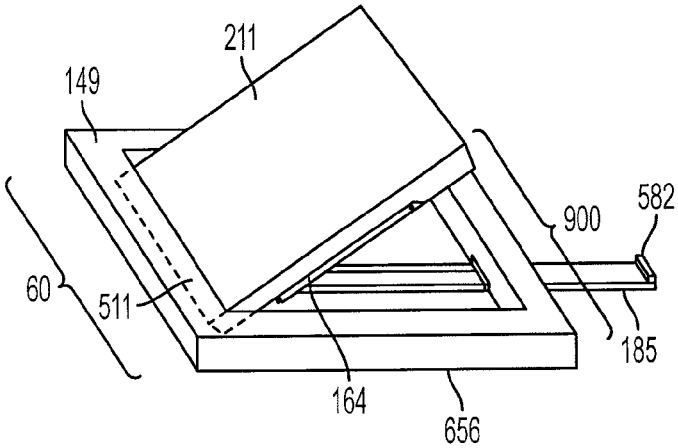
Figure 17C:
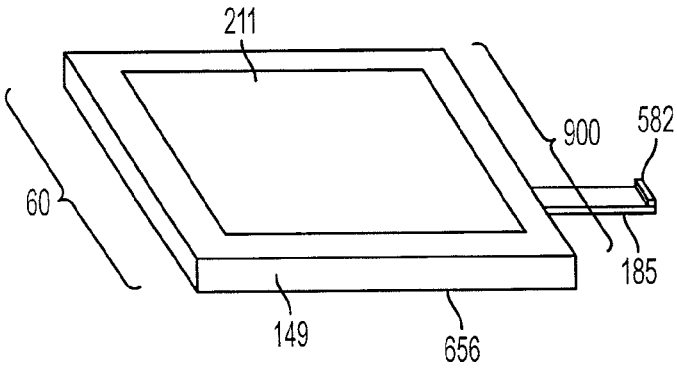

In an embodiment, the face plate (211) of the collapsible pop-up assist (656) may be sized to fit relatively snuggly inside the housing (149) when in its collapsed position as shown in FIG. 17(*c*). Although the face plate (211) of FIG. 14 is generally rectangular, this application contemplates any size or shaped face plate (211) known to those skilled in the art, that can function to support a user (351) paddling in the prone position on a surfboard (304). The face plate (211) of FIG. 14 has functional similarity to a door inside a door frame, hinging from an upright position of support for a user (351), to collapsing to a flat position flush with the housing (149) and the deck of the surfboard (154).

In an embodiment, the face plate (211) is attached to the housing (149) with a hinged mechanism (511). In an embodiment, the hinged mechanism (511) is a spring-loaded or otherwise biased hinge (511) attached toward the distal end (60) of the housing (149). Any kind of hinge can be used to connect the face plate (211) to the housing (149) that allows for a range, either limited or fixed, of rotation between the face plate (211) and the housing (149) generally around an axis of rotation. In an embodiment, the hinge (511) attachment is analogous to the attachment of a door to a door frame. In the depicted embodiment, the hinged mechanism (511) is biased to act to return the face plate (211) from the upright position downward towards the deck of the surfboard (154). In other words, the spring-loaded hinge (511) is consistently exerting a downward force on the face plate (211), pushing it downward toward the collapsed position of FIG. 17(*c*). The point of equilibrium occurs when the face plate (211) is generally flush inside the housing (149) and generally parallel to the deck of the surfboard (154).

To inhibit the face plate (211) from always being in the collapsed position, the brace (164) acts as a resistance mechanism against this downward force, stabilizing the face plate (211) in the upright wedge-like position of FIG. 17(*a*). In other words, the brace (164) is the component of the collapsible pop-up assist (656) that is designed to keep the spring-loaded face plate (211) in the upright position. When the face plate (211) is in the upright position, the brace (164) is generally perpendicular to the housing (149) and the face plate (211) generally rests toward the distal end (555) of the brace (164), as seen in FIG. 14. This creates a generally wedge-like shape between the face plate (211), brace (164) and housing (149), with the portion of the wedge-like shape greatest in height located toward the proximal end (900) of the collapsible pop-up assist (656), and generally defined by the height of the brace (164) in its upright position. In an embodiment, the brace (164) may be about 1" tall by about 9"-10" wide and rectangular in shape, as seen in FIG. 15. By no means however are these dimensions and shape determinative as this application contemplates the dimension or shape of any brace that can support a face plate (211) in the upright position.

When in the generally perpendicular position to the housing (149), the brace (164) supports the springloaded face plate (211) by propping up the face plate (211) toward the proximal end (900) of said face plate, preventing said face plate from collapsing to the collapsed position of FIG. 17(*a*). This forms a generally wedge shape support structure on the deck of the surfboard (154). In other words, the brace (164) acts analogously to the vertical arm of an isosceles triangle and the face plate (211) acts analogously to the hypotenuse; when in the upright position the brace (164) holds the face plate (211) "up" in its angled position from the proximal (900) to the distal (60) end. In the upright wedge shape position, the collapsible pop-up assist (656) functions as a support for a user (351), easing the strain inherent in paddling and placing the user's (351) upper torso in a position that makes the paddling motion easier to attain while the user (351) is lying in the prone position on the board (304).

As seen in FIG. 14 and FIG. 15, the distal end (555) of the brace (164) supports or "holds up" the face plate (211) by being placed generally toward the proximal end (900) of the face plate (211). In a preferred embodiment, the distal end (555) of the brace (164) is attached or hinged toward the proximal end (900) of the face plate (211) via a hinge or similar system. In an embodiment, this attachment or hinge is spring loaded or otherwise biased to return the brace (164) to a position generally parallel to the face plate (211). As seen in FIG. 15, in an embodiment there are holes toward the distal end (555) of the brace (164). A rod inserted into these holes from the face plate (211) attaches the face plate (211) and brace (164) in a preferred embodiment. In another embodiment, the underside of the face plate (211) (the side of the face plate (211) closest to the deck of the surfboard (154) in the collapsed position) has a ledge (363) shaped divet that the distal end (555) of the brace (164) rests in to support the face plate (211) in the upright position. Importantly, neither of these embodiments of the collapsible pop-up assist (656) are exclusive as this application contemplates any shape or method of "propping up" between the brace (164) and the face plate (211).

In an embodiment, the brace (164) is secured in the upright position to hold or support the face plate via a locking mechanism known to those skilled in the art. This application contemplates any locking mechanism, known to those skilled in the art, that can secure the collapsible pop-up assist (656) in the upright position of FIG. 17(*a*) when a user (351) is lying prone on the surfboard (304) and needs the support of the collapsible pop-up assist (656). Such locking mechanisms include, but are not limited to, pin and hole systems, gear systems, electromagnetic systems and pulley systems.

FIG. 15 provides a closer view of the structure of an embodiment of a brace (164) and the locking mechanism of said brace (164). In this embodiment, the brace (164) has knobs or protrusions (787) generally located toward the proximal end (888) of the brace (164). Also located toward the proximal end (888) of the brace (164) is a pocket (916) and a push tab (169). In an alternative embodiment of the brace (164), the brace (164) does not have a push tab (169), but rather a biasing mechanism, such as a leaf spring or a coil spring, located toward the proximal end (888) of the brace (164). In an embodiment, there are holes in the housing (149) and/or surfboard (154) that generally correspond in shape and size to the protrusions (787) located toward the proximal end (888) of the brace (164). The protrusions (787), holes, pocket (916) and push tab (169) work generally in tandem as a locking mechanism to secure the brace (164) in the upright position as long as there is a weight placed upon the face plate (211). Generally, this weight will be the weight of a user's (351) chest/upper torso.

In the embodiment of this brace (164) illustrated in FIG. 15, there is a pushing tab (169) located in a pocket toward the proximal end (888) of the brace (164). In an embodiment, the push tab (169) may be dimensioned to fit inside the brace. In an embodiment, there dimensions will be about ⅛" to ¼" thick by about ½" wide by about 6" long, however a push tab (169) of any dimension may be used in other embodiments. The push tab (169) is generally biased to act to return the brace (164) from the upright position of FIG. 17(*a*) to the collapsed position of FIG. 17(*c*). In an embodiment the push tab (169) is spring loaded (292). This spring (292), which may be any type of spring such as a coil or leaf spring, exerts a generally constant force on the push tab (169), pushing it generally out of the pocket. In other words, the general direction of the force exerted by the springs (292) is downward towards the deck of the surfboard (154), so that when the brace (164) is in the upright position, as seen in FIG. 14 and FIG. 17(*a*), generally there is a constant force "pushing" on the brace (164) urging it to collapse to the collapsed position of FIG. 17(*c*). Accordingly, the position of equilibrium for the brace (164) is a position in which the brace (164) is generally parallel to the deck of the surfboard (154). As such, to remain in the upright position, lifting the face plate (211) to create a generally wedge-like shape to support a user's (351) chest/upper torso, there must be a locking mechanism present to counteract the generally downward "collapsing" force of the spring (292). This application contemplates any locking mechanism known to those skilled in the art that can counteract this downward "collapsing" force and retain the collapsible pop-up assist (656) in the upright position so long as the user (351) needs the collapsible pop-up assist (656) in the upright position to support said user's (351) chest/upper torso while the user (351) is lying prone on the surfboard (304).

In an embodiment of the collapsible pop-up assist shown in FIG. 15, the components of the brace (164) work to stabilize the brace (164) in the upright supporting position, accordingly creating a wedge-like shape with the housing (149), face plate (211) and brace (164). When the locking mechanism of the brace (164) is no longer engaged, counteracting the downward collapsing forces acting on the face plate (211) and brace (164), the upright position of the collapsible pop-up assist (656) collapses.

This movement of the pop-up assist from the upright to the collapsed position can be described in a series of steps as follows. In step 1, as seen in FIG. 17(*a*), the collapsible pop-up assist is in the upright supportive position. In the upright position, the protrusions (787) at the proximal end (888) of the brace (164) are generally inside the holes located at the base of the housing (149). The weight of a user's (351) chest/torso when lying in the prone position on a surfboard (304), with their chest/torso on the raised face plate (211), keeps the protrusions (787), inserted into the holes in the base of the housing (149), locking the collapsible pop-up assist in the upright position, despite the opposing forces of the spring-loaded hinge (511) of the face plate (211) and the springs (292) of the brace (164) urging the structure to collapse.

In step 2, the user (351) has reached the break or wave and "pops-up" to stand on the board (301) so he or she can ride or surf the wave. When the user (351) "pops up," and the downward force of his or her chest/torso on the face plate (211) is removed, there is no longer a downward force acting on the brace (164) to keep the protrusions (787) of the brace (164) inserted into the holes, locking the collapsible pop-up assist (656) in the upright position. In other words, once the weight of a user's (350) chest is removed the protrusions (787) of the brace (164) "pop-out" of the holes due to the downward force of the spring (292) on the push tab (169).

In step 3, as is illustrated in FIG. 17(*b*), after the protrusions (787) of the brace (164) have "popped-out" out the holes, the downward force of the spring (292) on the push tab (169) pushes the brace loose of the locking mechanism and drives the brace (164) toward the face plate (211). In other words, the brace (164) hinges on the hinged attachment (484) toward the proximal end (900) of the face plate (211) and toward the distal end (555) of the brace (164), and the proximal end (888) of the brace (164) moves generally parallel to the underside of the face plate (211). In this generally parallel position, the proximal end (888) of the brace (164) is generally aligned with the distal end (60) of the face plate, as seen in FIG. 17(*b*).

In step 4, the downward force of the spring-loaded hinged mechanism (511) pushes the face plate (211), and the brace (164) that is now generally parallel to its underside, towards the deck of the surfboard (154).

In the final step, as is illustrated in FIG. 17(*c*), the collapsible pop-up assist (656) is in the collapsed position. In the collapsed position, the face plate (211) is generally flush with the housing (149) and the obstruction of the collapsible pop-up assist (656) in the upright position is removed with the brace (164) now being generally parallel with the face plate (211) which is now generally parallel to the deck of the surfboard (154).

Thus, taken together, with the removal of the weight of a user's (351) chest/torso on the face plate (211), the downward force of the spring-loaded hinge (511) of the face plate (211) and the downward force of the springs (292) on the base (164) act to push the protrusions (787) from the holes in the housing (149), thus causing the face plate (211) and brace (164) to collapse towards each other and towards the deck of the surfboard (154). This collapsing results with the collapsible pop-up assist in a collapsed position as depicted in FIG. 17(*c*). In the collapsed position, the face plate (211) is generally flush with the housing (149) and the brace (164) is generally parallel to the deck of the board (154) beneath it, creating a generally flat surface with relatively little extension beyond the deck of the surfboard (154) and eliminating the protrusion or obstacle of the collapsible pop-up assist (656) in its upright position for a user (351) then standing on the surfboard (304), that is from the position of FIG. 17(*c*) to the position of FIG. 17(*a*).

The pulling tab (185) is the component of the collapsible pop-up assist (656) that is utilized to assist in transitioning the collapsible pop-up assist (656) from its collapsed to its upright position.

In an embodiment, the pulling tab (185) is located toward the proximal end (900) of the housing (149), on the side of the housing (149) generally closest to the nose (43) of the surfboard (304). The distal end (60) of the pulling tab (185) is attached to the proximal end (888) of the brace (164) in a way known to those skilled in the art. In an embodiment, the pulling tab (185) will generally be attached via a bendable connector, flexible material, hinge or via another method known to those skilled in the art. The pulling tab (185) will generally be composed of a flexible plastic, or any other material known to those skilled in the art that can be pulled by a user (351) and connected to the collapsible pop-up assist (656) such that, when pulled, the collapsible pop-up assist (656) is lifted to the upright position of FIG. 17(*a*) from the collapsed position of FIG. 17(*c*). In another embodiment, the pulling tab (185) will be comprised of a cable, analogous to a bicycle braking-system cable, housed in a generally flexible round tubing sheath. This embodiment, due to its inherent flexibility, provides a user (351) a means to place the end of the pulling tab (185) anywhere on the board that is convenient for a user (351) to access. For example, a user (351) could place the end of the pull tab (185) on the rail of the surfboard (304) or the outside edge of the deck of the surfboard (304), among other positions.

The movement of the collapsible pop-up assist from the collapsed flush position to the upright position can be described in a series of steps as follows. In a first step, the pulling tab (185) is activated by a user (351) "pulling" the tab (185) towards the nose (43) of the surfboard (304) by forcing the pulling tab (185) towards the nose (43). Generally, this "pulling" action would be performed with the user's (351) thumb or other dominant finger or fingers and will often be performed while the user (351) is lying on the deck of the surfboard (154), while momentarily raising one's chest at the moment of the activation of the pull tab (185).

In a second step, this "pulling" force exerted on the proximal end (900) of the pulling tab (185) to push it out towards the nose (43) also moves the proximal end (888) of the brace (164) away from its collapsed position generally parallel to the face plate (211) and back to the upright position.

In a third step, this "pulling force" that raises the brace (164) back into the upright position, also moves the protrusions (787) located toward the proximal end (888) of the brace (164) back towards the holes in the housing.

In a fourth step, the protrusions (787) are lined up (149) within the holes of the housing by the pulling force and dropped into the holes such that each protrusion (787) "falls-in" its corresponding hole by the user exerting their weight on the face plate (211).

In a final step, the downward force of the weight of the user's (351) chest/upper torso lying on the face plate (211) locks the protrusions (787) in the holes, and accordingly the collapsible pop-up assist (656), in the upright position.

The pulling tab (185) is simple and easy to function for a user (351) both on the shore and on the water while surfing. Before "catching" his or her first wave the pulling tab (185) can be easily engaged by a user (351) holding a surfboard (304) under his or her arm and running out to the waves, such that the collapsible pop-up assist (656) will be in the raised supportive position as a user (351) gets into the water to paddle out to the break. The pulling tab (185) is similarly easy to use while a user (351) is on the water, after he or she has finished riding a wave and needs to paddle back out to the break. At this time, the user (351) will again generally be lying in the prone position on the surfboard (351). While many movements would be uncomfortable and/or throw a user (351) off balance in such a position, as a user's (351) arms can still be easily pushed or moved toward the nose (43) of the surfboard (304) the "pulling" of the pull tab (185) towards the nose (43) of the surfboard (304) required to raise the collapsible pop-up assist (656) back up into its upright position can be easily and quickly accomplished by a user (351), and a user (351) would not generally lose his or her center of gravity in doing so. Accordingly, the collapsible pop-up assist (656) is a "user-friendly" device that does not cause a significant hassle to a user (351) to re-raise in between waves.

In an embodiment, the brace (164) when in the upright position, is at an angle leaning toward the higher, proximal end (900) of the face place (211). This angle of the brace (164)

generally aides the placement of the protrusions (787) inside the holes of the base of the housing (149).

In an embodiment, the bottom of the push tab (169) has an angled end surface, to allow easier sliding and collapsing of the collapsible pop-up device (656) and a smooth transition between the upright and collapsed position.

In another embodiment, the pull tab (185) has a knob (582) located toward its proximal end (900), making it easier for a user (351) to extend or "pull" the tab and raise the device (656) back to its upright position.

In another embodiment, the collapsible pop-up assist (656), as seen in FIG. 16, is not an attachment to a surfboard (304), but is rather built-in or embedded into the surfboard (304) itself. In such an embodiment, the collapsible pop-up assist (656) may be positioned so that in the collapsed position of FIG. 17(*c*), the surface of the face plate (211) contacted by the body of a user (351) is generally flush with the deck of the surfboard (154) providing for the collapsible pop-up assist (656) to be out of the way of a user (351).

While the above has discussed a certain construction of a collapsible pop-up assist (656), this construction is by no means necessary and other devices can be developed without undue experimentation which function as a generally wedge-shaped device that supports and aids a user (351) in paddling and popping up and automatically, or on command, collapses after a user (351) has popped up on the surfboard (304). For example, this application contemplates collapsible pop-up assists that collapse in-sync with a timing mechanism, collapsible pop-up assists that collapse and raise on voice command, collapsible pop-up assists that collapse on the press of a button, collapsible pop-up assists that collapse and raise via sensor technology and collapsible pop-up assists that collapse and raise via photovoltaics, among many other devices.

It should be recognized that while the above description focused on the use of the device in accordance with a surfboard, these descriptions may also be used in utilizing the device in conjunction with a paddleboard. However, on a paddleboard, the user generally will not pop-up so the device is likely to be differently positioned and arranged so as to support paddling only, instead of paddling and popping-up.

While the invention has been disclosed in connection with certain preferred embodiments, this should not be taken as a limitation to all of the provided details. Modifications and variation of the described embodiments may be made without departing from the spirit and scope of the invention, and other embodiments should be understood to be encompassed in the present disclosures as would be understood by those in ordinary skill in the art.

The invention claimed is:

1. A collapsible pop-up assist device for attachment to a deck of a surfboard, said collapsible pop-up assist comprising:

a face plate having an upright and a collapsed position; and a brace having an upright and a collapsed position;

wherein, after being attached to said surfboard:

when said face plate and said brace are both in said upright position, said face plate is positioned at an angle to said deck of said surfboard so as to form a general wedge shape with said deck of said surfboard;

when said face plate and said brace are in said collapsed position, said face plate and said brace are generally parallel to said deck of said surfboard;

when in said upright position, said faceplate is in contact with a user of said surfboard; and when said contact between said user and said faceplate is removed, said faceplate transitions from said upright position to said collapsed position.

2. The collapsible pop-up assist of claim 1 further comprising a locking mechanism;

wherein said locking mechanism secures said brace in said upright position when said faceplate is in contact with said user of said surfboard.

3. The collapsible pop-up assist of claim 2 wherein said locking mechanism comprises a pin and hole system.

4. The collapsible pop-up assist device of claim 1, wherein said collapsible pop-up assist device is attached to a deck of a surfboard by hook and loop fastener.

5. The collapsible pop-up assist device of claim 1, wherein the said collapsible pop-up assist device is built-into said surfboard.

6. The collapsible pop-up assist device of claim 1, wherein said face plate is covered by a layer of a cushioning substance, said cushioning substance comprising at least one material selected from the group consisting of: rubber, foam, and neoprene.

7. The collapsible pop-up assist device of claim 1, wherein said collapsible pop-up assist device comprises at least one material selected from the group consisting of: hard plastic, metal, wood, and hard rubber.

8. The collapsible pop-up assist device of claim 1, wherein said face plate is a generally rectangular 10" wide by 6" long plate.

9. The collapsible pop-up assist device of claim 1, wherein said brace is generally a rectangular 1" tall by 7" wide plate.

10. The collapsible pop-up assist device of claim 1, wherein a distal end of said brace is attached toward a proximal end of said face plate.

11. The collapsible pop-up assist of claim 1, wherein said collapsible pop-up assist further comprises:

a housing;

wherein said housing encloses a perimeter of said faceplate and said brace when said faceplate and said brace are in said collapsed position and said housing attaches said collapsible pop-up assist to said deck of said surfboard.

12. The collapsible pop-up assist device of claim 11, wherein said housing is generally a rectangular 10" by 6" long by ½" thick frame.

13. The collapsible pop-up assist device of claim 11, wherein said faceplate is attached to said housing via a hinged mechanism.

14. The collapsible pop-up assist device of claim 12, wherein said face plate is biased to said collapsed position.

15. The collapsible pop-up assist of claim 1, wherein said collapsible pop-up assist further comprises:

a push tab;

wherein said push tab is located toward the proximal end of said brace; and wherein said push tab is biased to force said brace from said upright position to said collapsed position.

16. The collapsible pop-up assist device of claim 15, wherein said push tab is generally 1" wide by 6" long.

17. The collapsible pop-up assist of claim 1, wherein said collapsible pop-up assist further comprises:

a pull-tab;

wherein said pull tab has a distal end and a proximal end, said distal end attached to said brace and said proximal end generally extending out toward a nose of said surfboard; and wherein said pull tab is used to transition said collapsible pop-up assist from said collapsed position to said upright position.

18. The collapsible pop-up assist device of claim 17, wherein said pull tab has a knob located at its proximal end.

19. A surfboard comprising:

a deck originating at a tail and extending to a nose;

a bottom opposing said deck and including at least one fin;

a generally wedge shaped protrusion positioned on said deck between said nose and said tail and having an upright and a collapsed position, in said upright position said protrusion extending from said deck with a taller proximal end of said protrusion positioned toward said nose and a shorter distal end of said protrusion positioned toward said tail;

wherein said wedge shaped protrusion collapses from said upright position to said collapsed position when a weight is removed from said wedge.

* * * * *